US012329255B1

(12) United States Patent
Williams

(10) Patent No.: US 12,329,255 B1
(45) Date of Patent: Jun. 17, 2025

(54) PORTABLE WIG STORAGE DEVICE

(71) Applicant: Samantha D. Williams, Kinston, NC (US)

(72) Inventor: Samantha D. Williams, Kinston, NC (US)

( * ) Notice: Subject to any disclaimer, the term of this patent is extended or adjusted under 35 U.S.C. 154(b) by 79 days.

(21) Appl. No.: 18/480,096

(22) Filed: Oct. 3, 2023

(51) Int. Cl.

| | |
|---|---|
| ***A45C 11/00*** | (2006.01) |
| ***A45C 7/00*** | (2006.01) |
| ***A45C 13/02*** | (2006.01) |
| ***A45C 13/10*** | (2006.01) |
| ***A45C 15/04*** | (2006.01) |

(52) U.S. Cl.
CPC ..... *A45C 11/00* (2013.01); *A45C 7/0054* (2013.01); *A45C 13/02* (2013.01); *A45C 13/103* (2013.01); *A45C 15/04* (2013.01)

(58) Field of Classification Search
CPC ..... A45C 11/00; A45C 7/0054; A45C 13/02; A45C 15/04; A45C 13/103
USPC ..... 206/527, 349, 525; 190/110
See application file for complete search history.

(56) References Cited

U.S. PATENT DOCUMENTS

| | | | | |
|---|---|---|---|---|
| 1,519,873 | A | 12/1924 | Mosonillo | |
| 3,139,133 | A * | 6/1964 | Spector | A45C 7/0095 190/111 |
| 3,381,119 | A | 4/1968 | Brickman et al. | |
| 5,562,204 | A * | 10/1996 | Sapyta | A45C 7/0054 190/110 |
| 6,554,001 | B1 * | 4/2003 | Godshaw | A45D 42/04 132/316 |
| 7,409,790 | B2 * | 8/2008 | Stepp | A47B 96/16 109/51 |
| 7,798,323 | B1 * | 9/2010 | McCann | A61F 17/00 206/370 |
| D677,833 | S | 3/2013 | Key | |
| 8,439,210 | B1 | 5/2013 | Griffith | |
| 8,727,110 | B2 * | 5/2014 | Walsh | A47G 29/08 206/6.1 |
| 9,375,064 | B1 * | 6/2016 | Nuculaj | A45C 9/00 |
| 9,380,891 | B2 | 7/2016 | Wittenberg | |
| 10,722,011 | B2 | 7/2020 | Grund | |
| 2003/0042160 | A1 * | 3/2003 | Godshaw | B25H 3/023 206/349 |
| 2003/0221924 | A1 * | 12/2003 | Tong | A45C 11/20 190/110 |
| 2005/0016808 | A1 * | 1/2005 | Sapyta | A45C 13/02 190/110 |

(Continued)

FOREIGN PATENT DOCUMENTS

WO 2020219611 10/2020

*Primary Examiner* — Rafael A Ortiz
(74) *Attorney, Agent, or Firm* — Kyle A. Fletcher, Esq.

(57) ABSTRACT

The portable wig storage device includes a plurality of enclosure panels, a plurality of internal compartments, a folding shelf, and one or more mirrors. The portable wig storage device may be operable to store and organize one or more wigs and wig accessories. The plurality of enclosure panels may form an enclosure that may fold into a folded configuration for transporting and storing. The plurality of enclosure panels may be unfolded to a flat configuration and hang vertically for use. In the flat configuration, the plurality of internal compartments, the folding shelf, and the one or more mirrors may be accessible. In the folded configuration, the plurality of internal compartments, the folding shelf, and the one or more mirrors may be concealed.

17 Claims, 8 Drawing Sheets

(56) References Cited

U.S. PATENT DOCUMENTS

| | | | | |
|---|---|---|---|---|
| 2009/0014267 | A1* | 1/2009 | Day | A45C 13/02<br>190/110 |
| 2011/0017624 | A1* | 1/2011 | Robertson | A45C 13/02<br>206/438 |
| 2011/0147428 | A1* | 6/2011 | Crawford | A45C 11/24<br>224/245 |
| 2012/0090215 | A1* | 4/2012 | Buie, II | A45C 13/02<br>42/95 |
| 2013/0341210 | A1* | 12/2013 | Goodwin | F42B 39/26<br>224/400 |
| 2016/0198819 | A1* | 7/2016 | Grund | A45C 13/1069<br>132/288 |
| 2017/0202325 | A1* | 7/2017 | Hodgson | A45C 13/103 |
| 2018/0279734 | A1* | 10/2018 | Kao | A45C 13/02 |
| 2018/0303222 | A1 | 10/2018 | Foreman | |
| 2022/0378228 | A1 | 12/2022 | Johnson | |

* cited by examiner

PORTABLE WIG STORAGE DEVICE

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of wig storage organizers, more specifically, a portable wig storage device.

Summary of Invention

The portable wig storage device comprises a plurality of enclosure panels, a plurality of internal compartments, a folding shelf, and one or more mirrors. The portable wig storage device may be operable to store and organize one or more wigs and wig accessories. The plurality of enclosure panels may form an enclosure that may fold into a folded configuration for transporting and storing. The plurality of enclosure panels may be unfolded to a flat configuration and hang vertically for use. In the flat configuration, the plurality of internal compartments, the folding shelf, and the one or more mirrors may be accessible. In the folded configuration, the plurality of internal compartments, the folding shelf, and the one or more mirrors may be concealed.

An object of the invention is to store and organize one or more wigs and wig accessories within a device that may fold into a folded configuration for transportation and storage and may unfold to a flat configuration for use.

Another object of the invention is to provide a plurality of internal compartments for storing the wigs and accessories.

A further object of the invention is to provide one or more mirrors and one or more puck lights for use while donning a wig.

Yet another object of the invention is to provide a folding shelf.

These together with additional objects, features and advantages of the portable wig storage device will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable wig storage device in detail, it is to be understood that the portable wig storage device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable wig storage device.

It is therefore important that the claims be regarded as including such equivalent construction insofar as they do not depart from the spirit and scope of the portable wig storage device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
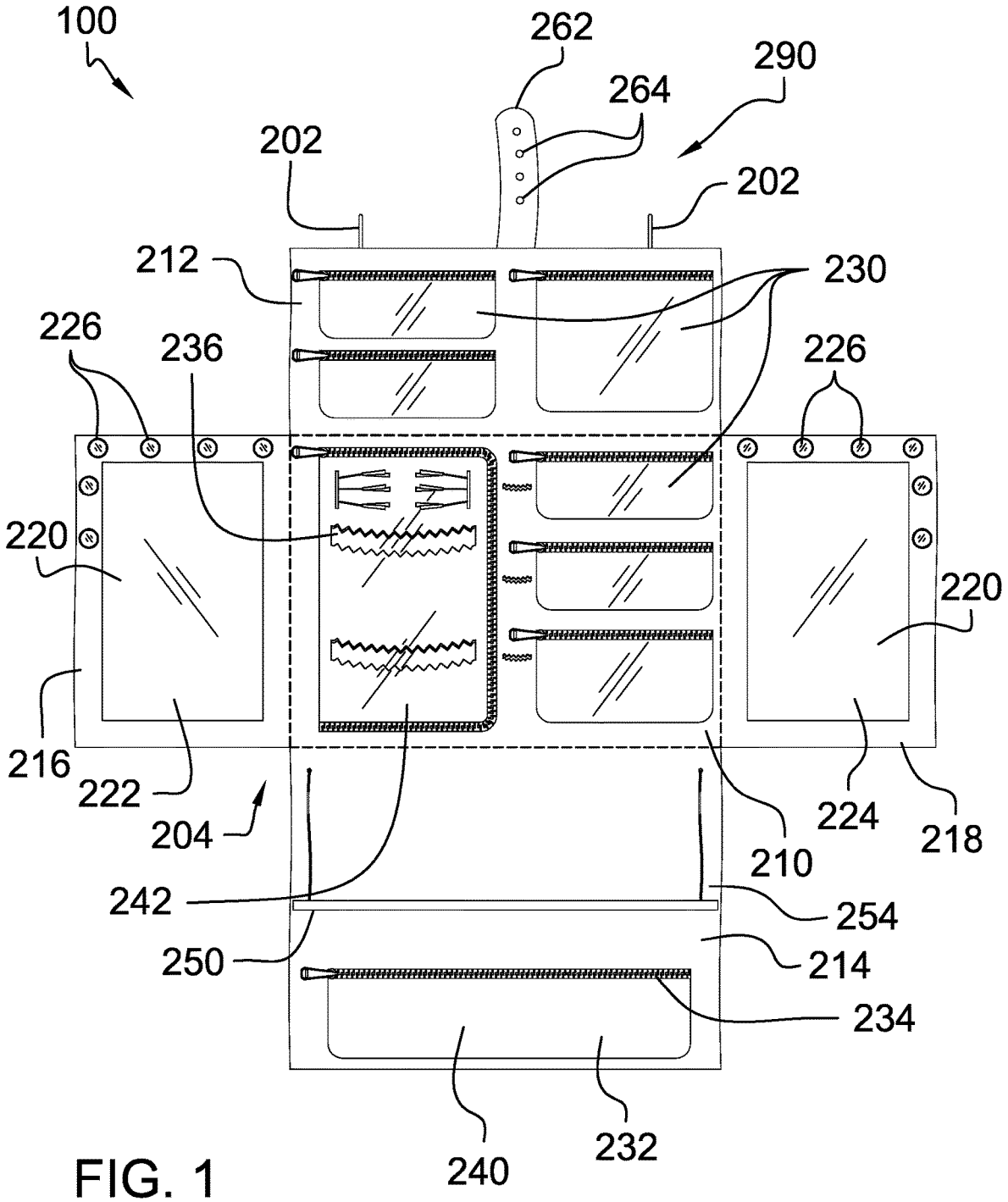
FIG. 1 is a front view of an embodiment of the disclosure in the flat configuration.
Figure 2:
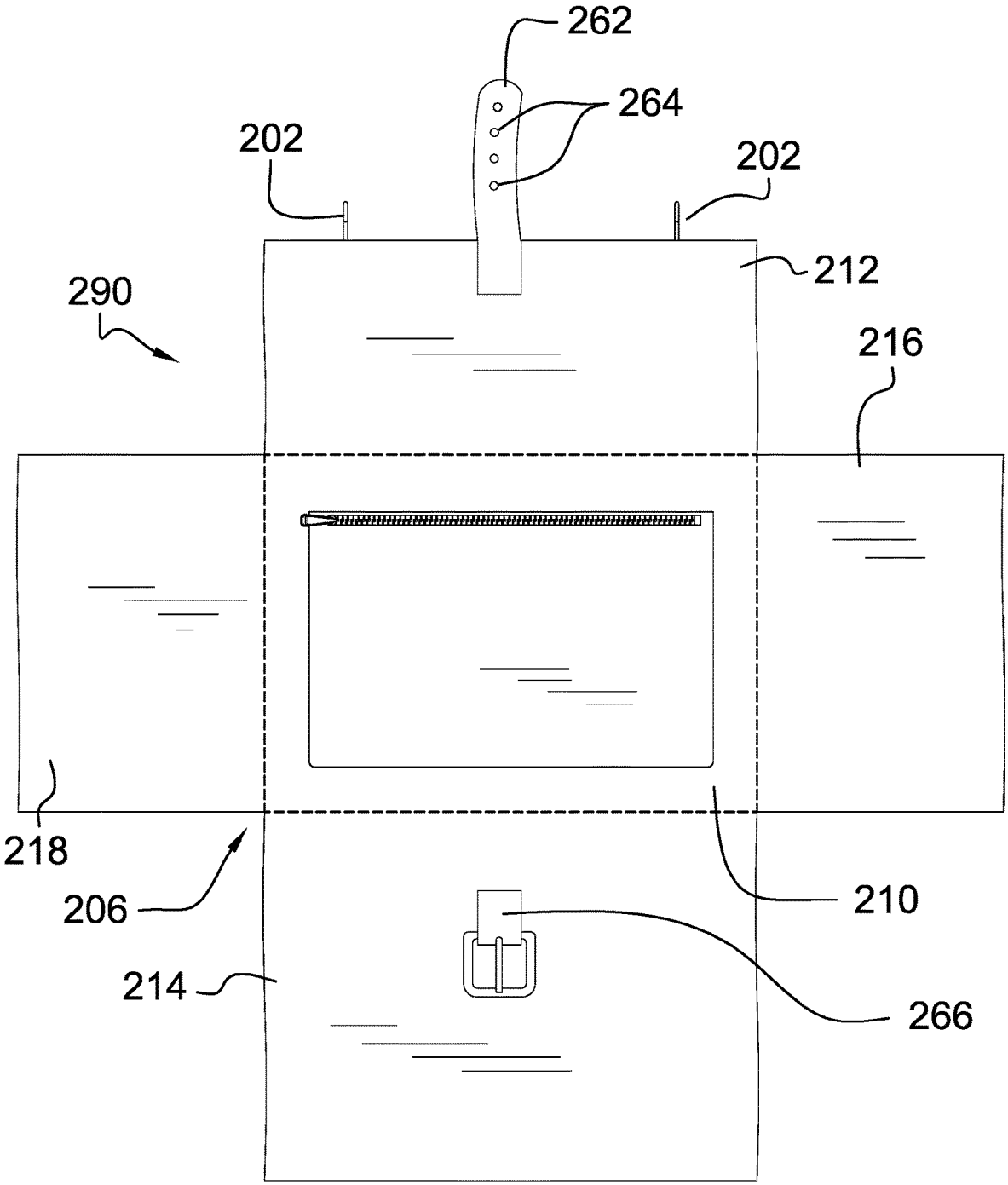
FIG. 2 is a rear view of an embodiment of the disclosure in the flat configuration.
Figure 3:
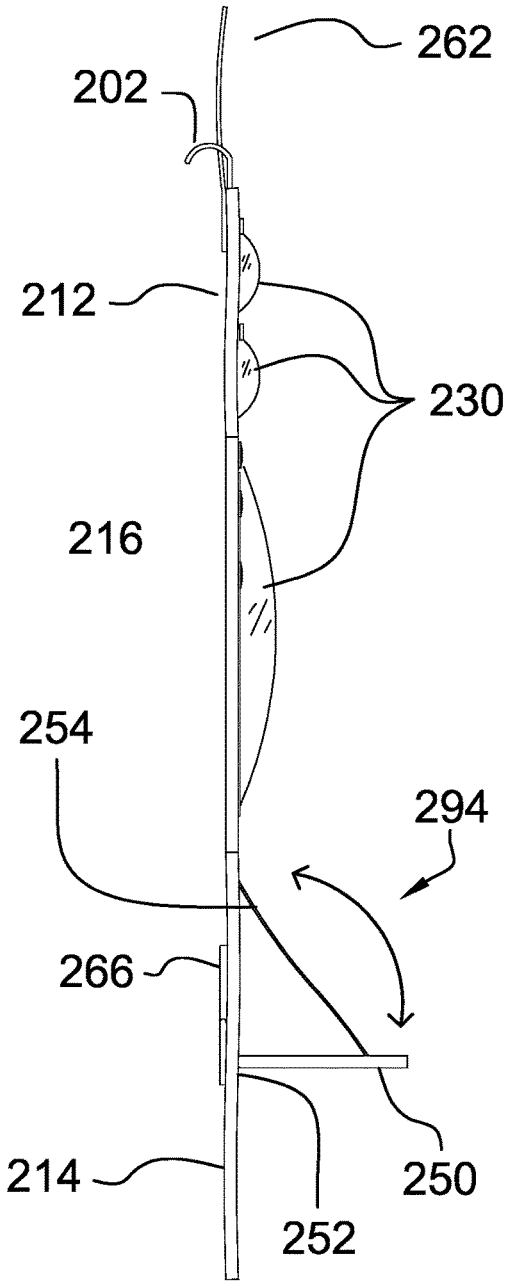
FIG. 3 is a left side view of an embodiment of the disclosure in the flat configuration.
Figure 4:
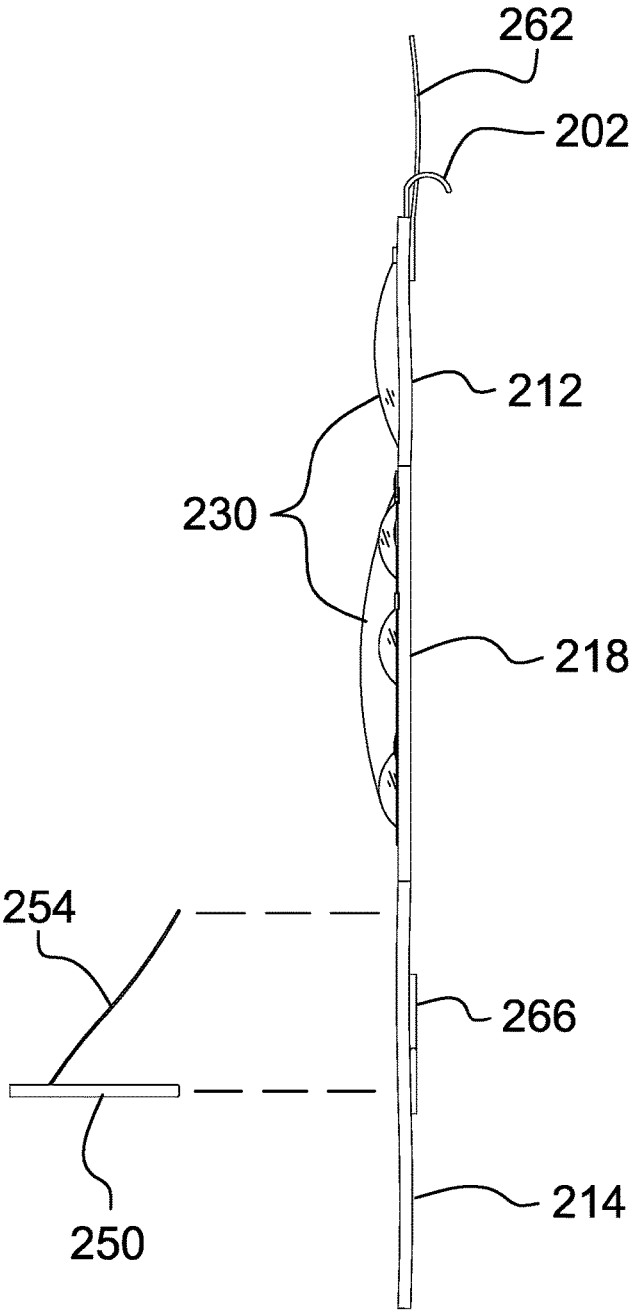
FIG. 4 is a right side view of an embodiment of the disclosure in the flat configuration.
Figure 5:
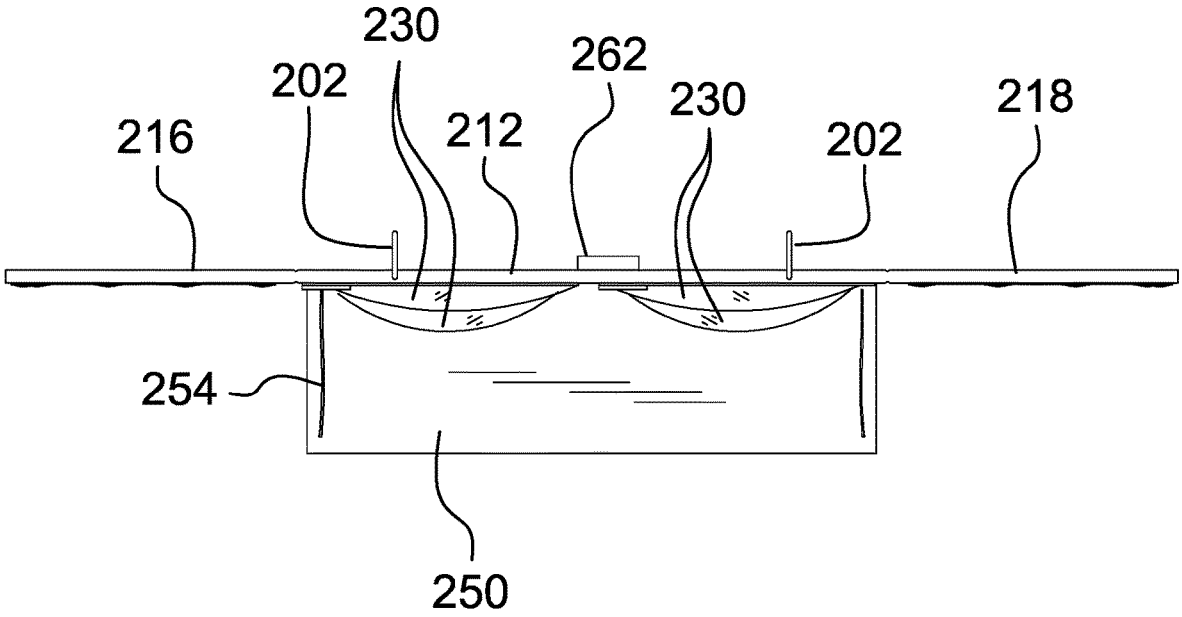
FIG. 5 is a top view of an embodiment of the disclosure in the flat configuration.
Figure 6:
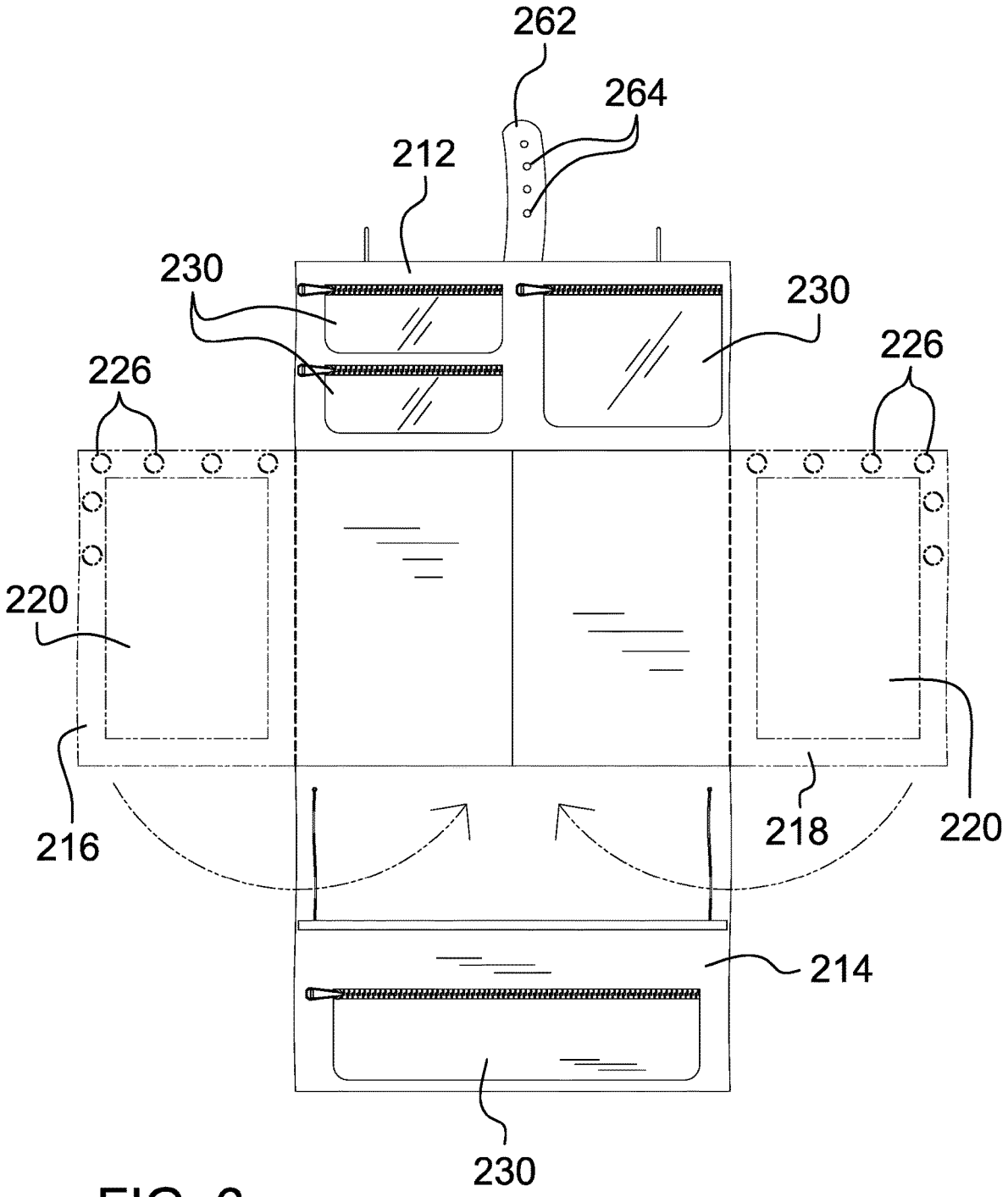
FIG. 6 is a front in-use view of an embodiment of the disclosure, illustrating the left panel and right panel folded onto the center panel.
Figure 7:
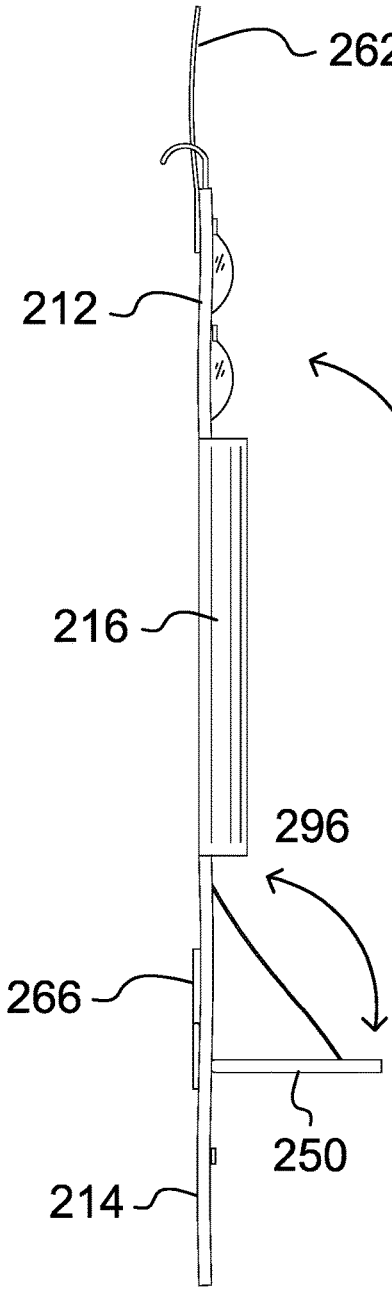
FIG. 7 is a left side in-use view of an embodiment of the disclosure.
Figure 8:
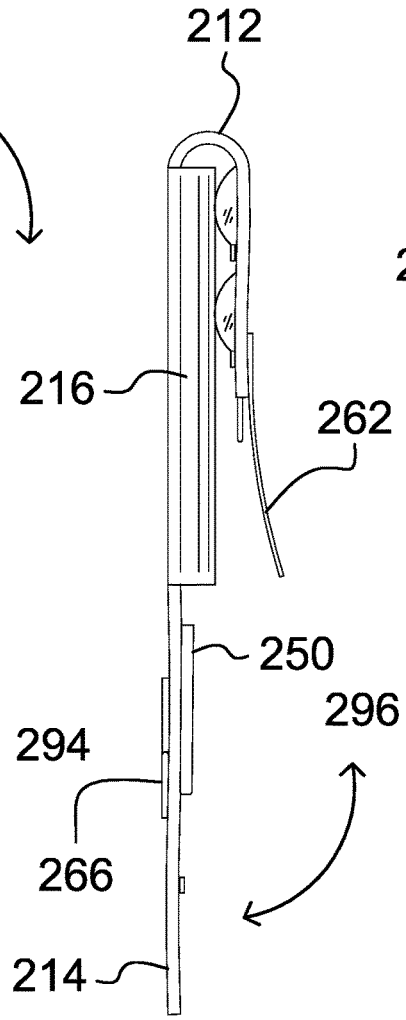
FIG. 8 is a left side in-use view of an embodiment of the disclosure, illustrating the folding shelf pivoted to the vertical orientation and the top panel folded down over the center panel.
Figure 9:
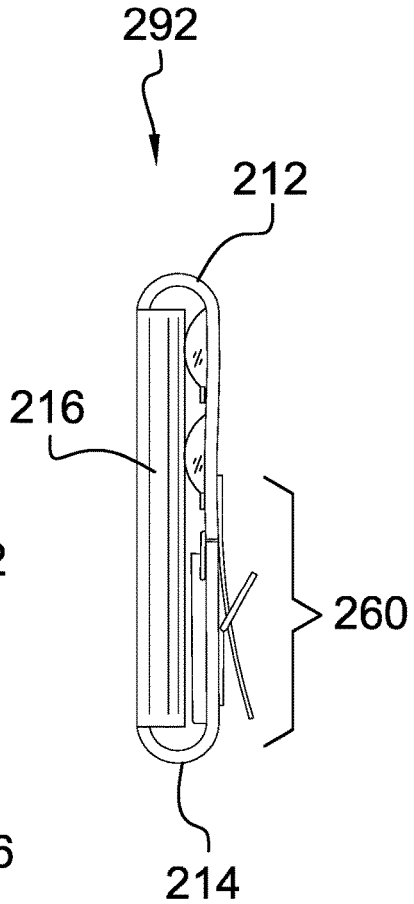
FIG. 9 is a left side in-use view of an embodiment of the disclosure, illustrating the bottom panel folded up over the center panel.
Figure 10:
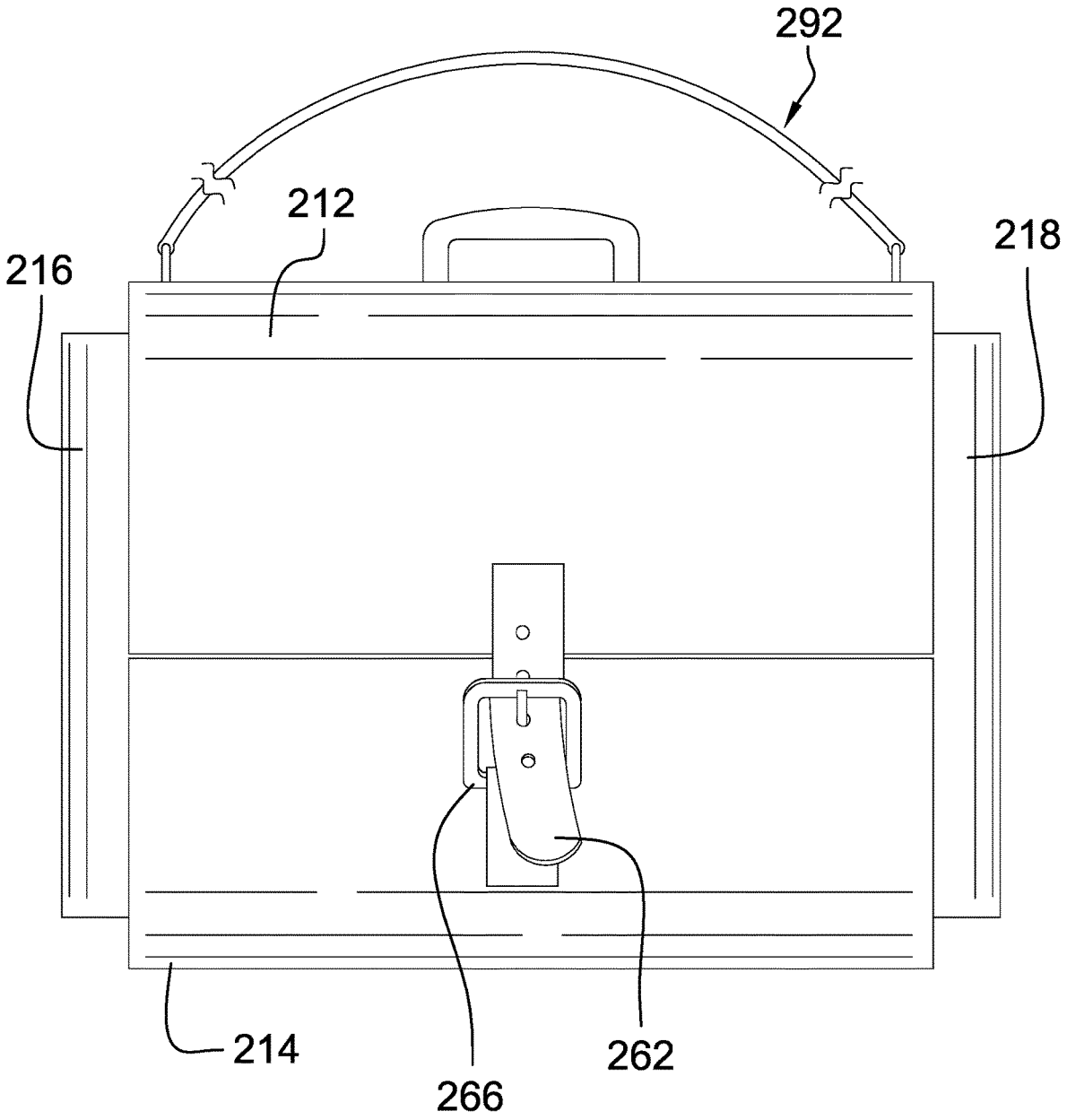
FIG. 10 is an in-use view of an embodiment of the disclosure, illustrating the folded configuration.
Figure 11:
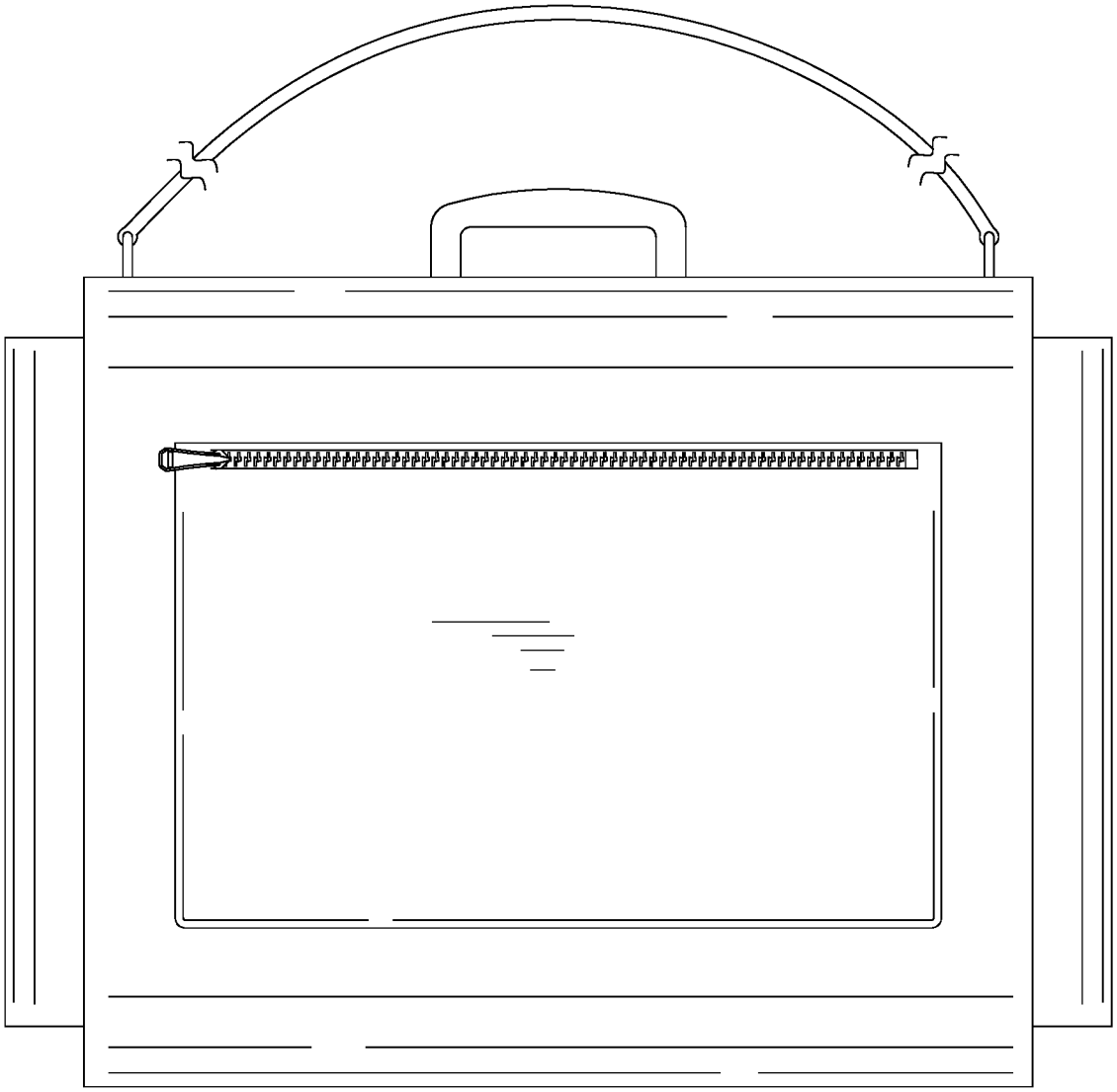

Detailed reference will now be made to a first potential embodiment of the disclosure, which is illustrated in FIGS. 1 through 10.

The portable wig storage device 100 (hereinafter invention) comprises a plurality of enclosure panels, a plurality of internal compartments 230, a folding shelf 250, and one or more mirrors 220. The invention 100 may be operable to store and organize one or more wigs and wig accessories. The plurality of enclosure panels may form an enclosure that may fold into a folded configuration 292 for transporting and storing. The plurality of enclosure panels may be unfolded to a flat configuration 290 and hung vertically for use. In the flat configuration 290, the plurality of internal compartments 230, the folding shelf 250, and the one or more mirrors 220 may be accessible. In the folded configuration 292, the plurality of internal compartments 230, the folding shelf 250, and the one or more mirrors 220 may be concealed.

As non-limiting examples, the wig accessories may comprise a liner, a lift comb, a wig holder, hairpiece tape, a pick comb, clips, and T pins.

Throughout this document, terms that invoke directionality or directional relationships such as top, bottom, up, down, above, below, height, and width, should be considered in the context of the invention 100 hung vertically in the flat configuration 290.

The plurality of enclosure panels may comprise a center panel 210, a top panel 212, a bottom panel 214, a left panel 216, and a right panel 218. The top panel 212 may be coupled to the top edge of the center panel 210 and the bottom panel 214 may be coupled to the bottom edge of the center panel 210—opposite the top panel 212. The left panel 216 may be coupled to the left edge of the center panel 210 and the right panel 218 may be coupled to the right edge of the center panel 210—opposite the left panel 216. The plurality of enclosure panels may fold where the center panel 210 couples to the top panel 212, the bottom panel 214, the left panel 216, and the right panel 218. In the flat configuration 290, the plurality of enclosure panels may form a cross shape.

The plurality of enclosure panels may define an inside wall 204 and an outside wall 206. The inside wall 204 and the outside wall 206 may be on opposite sides of the plurality of enclosure panels. The plurality of internal compartments 230, the one or more mirrors 220, and the folding shelf 250 may be coupled to the inside wall 204.

The invention 100 may be folded into the folded configuration 292 by folding the left panel 216 and the right panel 218 onto the inside wall 204 side of the center panel 210 and then folding the top panel 212 and the bottom panel 214 onto the center panel 210, over the left panel 216 and the right panel 218 so that only the outside wall 206 is exposed. The invention 100 may be unfolded into the flat configuration 290 by unfolding the top panel 212 and the bottom panel 214 and then unfolding the left panel 216 and the right panel 218.

The top of the top panel 212 may comprise one or more hooks for hanging the invention 100 in the flat configuration 290. As a non-limiting example, the invention 100 may be hung from a door by the one or more hooks 202.

The plurality of internal compartments 230 may be coupled to the inside wall 204 of the plurality of enclosure panels such that the plurality of internal compartments 230 may be accessible in the flat configuration 290. In a preferred embodiment, the plurality of internal compartments 230 may be coupled to the top panel 212, the center panel 210, and the bottom panel 214.

The plurality of internal compartments 230 may store the one or more wigs and/or the wig accessories. An individual internal compartment selected from the plurality of internal compartments 230 may comprise a pocket 232 and a fastener 234. The pocket 232 may store an item. The fastener 234 may secure the pocket 232 to retain the item. As a non-limiting example, the fastener 234 may be a zipper.

In some embodiments, one or more elastic straps 236 may be coupled to the front of a subset of the plurality of internal compartments 230. The one or more elastic straps 236 may be operable to retain frequently used items.

In some embodiments, the plurality of internal compartments may comprise at least one full width compartment 240 and/or at least one full height compartment 242. The at least one full width compartment 240 may extend the full width of an individual panel selected from the plurality of enclosure panels. The at least one full height compartment 242 may extend the full height of the individual panel.

The folding shelf 250 may be a rigid panel that may be hingedly coupled to the bottom panel 214 via a shelf hinge 252. A pair of flexible side supports 254 may be coupled between the front corners of the folding shelf 250 and the top of the bottom panel 214 in order to hold the folding shelf 250 in a horizontal orientation 294. The folding shelf 250 may pivot to a vertical orientation 296 for storage. In some embodiments, the folding shelf 250 and the pair of flexible side supports 254 may detach from the bottom panel 214. As a non-limiting example, the folding shelf 250 may be coupled to the bottom panel 214 by one or more hook and loop fasteners.

The one or more mirrors 220 may be adapted to reflect an image of a user to aid in donning the one or more wigs and/or to aid in applying cosmetics. In a preferred embodiment, the one or more mirrors 220 may comprise two mirrors. A left panel mirror may be coupled to the inside wall 204 of the left panel 216 and a right panel mirror 224 may be coupled to the inside wall 204 of the right panel 218.

The invention 100 may comprise one or more puck lights 226 to provide illumination. The one or more puck lights 226 may be battery-operated LED lights that may be located adjacent to an individual mirror selected from the one or more mirrors 220. The one or more puck lights 226 may be placed above the individual mirror, below the individual mirror, to the left of the individual mirror, to the right of the individual mirror, or any combination thereof.

The invention 100 may comprise a closure mechanism 260 to keep the folded configuration 292 closed. The closure mechanism may comprise a strap 262 coupled to the outside wall 206 of the top panel 212 and a buckle 266 coupled to the outside wall 206 of the bottom panel 214. The strap 262 may comprise a plurality of apertures 264 that are dispersed longitudinally along the strap 262. The strap 262 may be oriented to extend vertically above the top panel 212. In the folded configuration 292, the buckle 266 may be brought to a position that is adjacent to the strap 262 and the buckle 266 may engage one of the plurality of apertures 264 to restrain the plurality of enclosure panels.

In use, the invention 100 may be carried to a location while in the folded configuration 292 and opened by disengaging the buckle 266 from the strap 262. The plurality of enclosure panels may be unfolded and the flat configuration 290 may be hung vertically using the one or more hooks 202. An individual wig may be removed from one or the plurality of internal compartments 230 and may be donned while using the one or more mirrors 220 to assist in placement. The one or more puck lights 226 may be illuminated if additional light is needed. Wig accessories may be retrieved from the plurality of internal compartments 230 as needed. The folding shelf 250 may be pivoted to the horizontal orientation 294 and used to temporarily store items. When no longer needed, the wig accessories may be returned to the plurality of internal compartments 230, the folding shelf 250 may be pivoted to the vertical orientation 296, the plurality of enclosure panels may be folded, and the closure mechanism 260 may be engaged.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, the words "couple", "couples", "coupled" or "coupling", may refer to connecting, either directly or indirectly, and does not necessarily imply a mechanical connection.

As used in this disclosure, "elastic" may refer to a material or object that deforms when a force is applied to stretch or compress the material and that returns to its relaxed shape after the force is removed. A material that exhibits these qualities is also referred to as an elastomeric material.

As used in this disclosure, a "fastener" may be a device that is used to join or affix two objects. Fasteners may generally comprise a first element which is attached to the first object and a second element which is attached to the second object such that the first element and the second element join to affix the first object and the second object. Common fasteners may include, but are not limited to, hooks, zippers, snaps, clips, ties, buttons, buckles, quick release buckles, or hook and loop fasteners.

As used in this disclosure, "flexible" may refer to an object or material which will deform when a force is applied to it, which will not return to its original shape when the deforming force is removed, and which may not retain the deformed shape caused by the deforming force.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "hook" may be an object that is curved or bent at an angle such that items can be hung on or caught by the object or such that the object may be suspended from another object.

As used in this disclosure, "horizontal" may be a directional term that refers to a direction that is perpendicular to the local force of gravity. Unless specifically noted in this disclosure, the horizontal direction is always perpendicular to the vertical direction.

As used herein, the word "longitudinal" or "longitudinally" may refer to a lengthwise or longest direction or to a direction that is perpendicular to the lateral direction.

As used in this disclosure, a "mirror" may be a surface that is designed to reflect light with a minimum of dispersion or absorption. In some embodiments, a mirror may be formed with curved surfaces that are used to magnify the reflected image or to enlarge the field of view of the reflected image.

As used in this disclosure, "orientation" may refer to the positioning and/or angular alignment of a first object relative to a second object or relative to a reference position or reference direction.

As used in this disclosure, a "pocket" may be a pouch or storage space that is formed into an object. Pockets are often formed by joining a second textile or a second sheeting to a first textile or a first sheeting, respectively, by sewing or heat sealing respectively.

As used herein, "rigid" may refer to an object or material which is inflexible.

As used in this disclosure a "strap" may be a strip of leather, cloth, nylon, plastic, thin metal, rubber, or other flexible material, that is used to fasten, secure, carry, or hold onto something. A strap is sometimes used in conjunction with a buckle or other types of fasteners.

As used herein, "subset" may refer to a relationship between two sets. Set 'A' may be said to be a subset of set 'B' if all elements of set 'A' are also elements of set 'B'. The definition of subset allows that the membership of set 'A' may equal the membership of set 'B'. A subset may also be an empty set, meaning that the subset may have no members.

As used in this disclosure, "vertical" may refer to a direction that is parallel to the local force of gravity. Unless specifically noted in this disclosure, the vertical direction is always perpendicular to horizontal.

As used in this disclosure, a "zipper" may be a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 10, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable wig storage device comprising:

a plurality of enclosure panels, a plurality of internal compartments, a folding shelf, and one or more mirrors;

wherein the portable wig storage device is operable to store and organize one or more wigs and wig accessories;

wherein the plurality of enclosure panels form an enclosure that folds into a folded configuration;

wherein the plurality of enclosure panels are unfolded to a flat configuration and hung vertically for use;

wherein in the flat configuration, the plurality of internal compartments, the folding shelf, and the one or more mirrors are accessible;

wherein in the folded configuration, the plurality of internal compartments, the folding shelf, and the one or more mirrors are concealed;

wherein the plurality of enclosure panels is further defined with a bottom panel;

wherein a pair of flexible side supports are coupled between the front corners of the folding shelf and a top of the bottom panel in order to hold the folding shelf in a horizontal orientation;

wherein the folding shelf pivots to a vertical orientation for storage;

wherein the folding shelf and the pair of flexible side supports detach from the bottom panel; and wherein the one or more mirrors comprise two mirrors; wherein a left panel mirror is coupled to an inside wall of the left panel and a right panel mirror is coupled to an inside wall of the right panel.

2. The portable wig storage device according to claim 1 wherein the plurality of enclosure panels comprises a center panel, a top panel, the bottom panel, a left panel, and a right panel;

wherein the top panel is coupled to the top edge of the center panel and the bottom panel is coupled to the bottom edge of the center panel—opposite the top panel;

wherein the left panel is coupled to the left edge of the center panel and the right panel is coupled to the right edge of the center panel—opposite the left panel;

wherein the plurality of enclosure panels fold where the center panel couples to the top panel, the bottom panel, the left panel, and the right panel.

3. The portable wig storage device according to claim 2 wherein the plurality of enclosure panels define the inside wall and an outside wall;

wherein the inside wall and the outside wall are on opposite sides of the plurality of enclosure panels;

wherein the plurality of internal compartments, the one or more mirrors, and the folding shelf are coupled to the inside wall.

4. The portable wig storage device according to claim 3 wherein the portable wig storage device is folded into the folded configuration by folding the left panel and the right panel onto the inside wall side of the center panel and then folding the top panel and the bottom panel onto the center panel, over the left panel and the right panel so that only the outside wall is exposed;

wherein the portable wig storage device is unfolded into the flat configuration by unfolding the top panel and the bottom panel and then unfolding the left panel and the right panel.

5. The portable wig storage device according to claim 4 wherein the top of the top panel comprises one or more hooks for hanging the portable wig storage device in the flat configuration.

6. The portable wig storage device according to claim 5 wherein the plurality of internal compartments are coupled to the inside wall of the plurality of enclosure panels such that the plurality of internal compartments are accessible in the flat configuration.

7. The portable wig storage device according to claim 6 wherein the plurality of internal compartments are coupled to the top panel, the center panel, and the bottom panel.

8. The portable wig storage device according to claim 6 wherein the plurality of internal compartments is operable to store the one or more wigs and/or the wig accessories;

wherein an individual internal compartment selected from the plurality of internal compartments comprises a pocket and a fastener;

wherein the pocket stores an item.

9. The portable wig storage device according to claim 8 wherein the fastener secures the pocket to retain the item.

10. The portable wig storage device according to claim 9 wherein the fastener is a zipper.

11. The portable wig storage device according to claim 9 wherein one or more elastic straps are coupled to the front of a subset of the plurality of internal compartments;

wherein the one or more elastic straps are operable to retain frequently used items.

12. The portable wig storage device according to claim 9 wherein the plurality of internal compartments comprise at least one full width compartment and/or at least one full height compartment;

wherein the at least one full width compartment extends the full width of an individual panel selected from the plurality of enclosure panels;

wherein the at least one full height compartment extends the full height of the individual panel.

13. The portable wig storage device according to claim 9 wherein the folding shelf is a rigid panel that is hingedly coupled to the bottom panel via a shelf hinge.

14. The portable wig storage device according to claim 1 wherein the one or more mirrors are adapted to reflect an image of a user to aid in donning the one or more wigs and/or to aid in applying cosmetics.

15. The portable wig storage device according to claim 14 wherein the portable wig storage device comprises one or more puck lights to provide illumination;

wherein the one or more puck lights are battery-operated LED lights that are located adjacent to an individual mirror selected from the one or more mirrors;

wherein the one or more puck lights are placed above the individual mirror, below the individual mirror, to the left of the individual mirror, to the right of the individual mirror, or any combination thereof.

16. The portable wig storage device according to claim 15 wherein the portable wig storage device comprises a closure mechanism to keep the folded configuration closed;

wherein the closure mechanism comprises a strap coupled to the outside wall of the top panel and a buckle coupled to the outside wall of the bottom panel;

wherein the strap comprises a plurality of apertures that are dispersed longitudinally along the strap;

wherein the strap is oriented to extend vertically above the top panel.

17. The portable wig storage device according to claim 16 wherein in the folded configuration, the buckle is brought to a position that is adjacent to the strap and the buckle engages one of the plurality of apertures to restrain the plurality of enclosure panels.

* * * * *